US010468216B2

(12) United States Patent
Marlin et al.

(10) Patent No.: US 10,468,216 B2
(45) Date of Patent: Nov. 5, 2019

(54) PYROTECHNIC CIRCUIT BREAKER WITH IMPROVED CUT OF THE BLADE

(71) Applicants: AIRBUS SAFRAN LAUNCHERS SAS, Paris (FR); LEONI BORDNETZ-SYSTEME GMBH, Kitzingen (DE)

(72) Inventors: Frédéric Marlin, Saint Medard en Jalles (FR); Jean-Paul Nadeau, Ollioules (FR); Evrard Borg, Eysines (FR); Peter Steiner, Burghaslach (DE); Martin Burger, Buchbrunn (DE)

(73) Assignees: ARIANEGROUP SAS, Paris (FR); LEONI BORDNETZ-SYSTEME GMBH, Kitzingen (DE)

( * ) Notice: Subject to any disclaimer, the term of this patent is extended or adjusted under 35 U.S.C. 154(b) by 0 days.

(21) Appl. No.: 15/509,768

(22) PCT Filed: Sep. 8, 2015

(86) PCT No.: PCT/EP2015/070512
§ 371 (c)(1),
(2) Date: Mar. 8, 2017

(87) PCT Pub. No.: WO2016/038044
PCT Pub. Date: Mar. 17, 2016

(65) Prior Publication Data

US 2017/0263403 A1 Sep. 14, 2017

(30) Foreign Application Priority Data

Sep. 9, 2014 (EP) ..... 14306382

(51) Int. Cl.
*H01H 39/00* (2006.01)
*H01H 71/10* (2006.01)
*H01B 5/02* (2006.01)

(52) U.S. Cl.
CPC ..... *H01H 39/006* (2013.01); *H01B 5/02* (2013.01); *H01H 71/10* (2013.01)

(58) Field of Classification Search
CPC ..... H01H 39/0006; H01H 71/10; H01B 5/02
(Continued)

(56) References Cited

U.S. PATENT DOCUMENTS 3,803,374 A * 4/1974 Delgendre ..... H01H 39/004 200/61.08
3,873,786 A * 3/1975 Lagofun ..... B23D 15/145 200/61.08
(Continued)

FOREIGN PATENT DOCUMENTS

CN 101283427 A 10/2008
CN 101925972 A 12/2010
(Continued)

OTHER PUBLICATIONS

International Search Report issued in corresponding International Application No. PCT/EP2015/070512, dated Dec. 2, 2015 (3 pages).
(Continued)

*Primary Examiner* — Anatoly Vortman
(74) *Attorney, Agent, or Firm* — Bookoff McAndrews, PLLC

(57) ABSTRACT

A pyrotechnic circuit breaker, comprising a body, an igniter, a bus bar, and a piston which comprises a cutting edge and is movable along a normal direction to cut a portion of the bus bar, thereby separating the bus bar to break a circuit, wherein the cutting edge of the piston is stepped so that the portion of the bus bar is cut sequentially, in at least two successive cutting operations, characterized in that the bus bar comprises a breakable portion configured to be cut by the cutting edge of the piston, wherein said breakable portion comprises slots in order to divide the breakable portion into
(Continued)

multiple sub-portions that are adapted to be cut sequentially by the stepped cutting edge of the piston.

8 Claims, 4 Drawing Sheets

(58) Field of Classification Search
USPC ..... 337/157
See application file for complete search history.

(56) References Cited

U.S. PATENT DOCUMENTS

| | | | | |
|---|---|---|---|---|
| 4,224,487 | A * | 9/1980 | Simonsen | H01H 39/006 200/61.08 |
| 5,535,842 | A * | 7/1996 | Richter | B60K 28/14 180/271 |
| 6,556,119 | B1 * | 4/2003 | Lell | H01H 37/323 180/279 |
| 6,954,132 | B2 * | 10/2005 | Lell | H01H 39/006 337/157 |
| 7,123,124 | B2 * | 10/2006 | Caruso | H01H 39/006 200/61.08 |
| 7,205,879 | B2 * | 4/2007 | Kordel | H01H 39/006 337/157 |
| 7,222,561 | B2 * | 5/2007 | Brede | B23D 15/145 200/61.08 |
| 7,498,531 | B2 * | 3/2009 | Knauss | H01H 39/006 200/61.08 |
| 7,511,600 | B2 * | 3/2009 | Von Behr | H01H 39/006 200/61.08 |
| 9,153,402 | B2 * | 10/2015 | Ukon | H01H 39/006 |
| 2005/0083165 | A1 | 4/2005 | Tirmizi | |
| 2012/0194954 | A1 * | 8/2012 | Fukuyama | H01H 39/006 361/62 |
| 2013/0056344 | A1 | 3/2013 | Borg | |
| 2013/0263714 | A1 * | 10/2013 | Ukon | H01H 39/006 83/639.1 |
| 2014/0326122 | A1 * | 11/2014 | Ukon | H01H 39/006 83/468.1 |

FOREIGN PATENT DOCUMENTS

| | | | | |
|---|---|---|---|---|
| CN | 103003907 | A | 3/2013 | |
| DE | 10 2006 032605 | A1 | 11/2007 | |
| EP | 2660842 | A1 | 11/2013 | |
| JP | 4973779 | B1 * | 7/2012 | H01H 39/006 |
| JP | 2013138004 | A | 7/2013 | |
| WO | 2014048913 | A1 | 4/2014 | |

OTHER PUBLICATIONS

English translation of Chinese Office Action in corresponding Chinese Application No. 201580048396, dated Jul. 26, 2018, 2018 (9 pages).

* cited by examiner

PYROTECHNIC CIRCUIT BREAKER WITH IMPROVED CUT OF THE BLADE

CROSS-REFERENCE TO RELATED APPLICATIONS

This application is the U.S. national phase entry under 35 U.S.C. § 371 of International Application No. PCT/EP2015/070512, filed on Sep. 8, 2015, which claims priority to and the benefit of European Patent Application No. 14306382.4, filed on Sep. 9, 2014, the entireties of which are herein incorporated by reference.

TECHNICAL FIELD

The invention relates to the field pyrotechnic circuit breakers.

BACKGROUND OF THE INVENTION

Pyrotechnic circuit breakers are widely used for disabling an electric circuit, for instance in response to abnormal conditions of use.

Conventional pyrotechnic circuit breakers use a bus bar acting as a conducting element, which can be cut or broken along its transverse direction into two distinct parts by a piston in order to break open the circuit by stopping the electric conduction between the two parts of the bus bar. In the present text, we will refer to the cutting of the bus bar by the piston, to designate either its cutting or its breaking by the piston.

Document EP 2660842 discloses a known circuit breaker which comprises a cutting tool with two distinct cutting edges, configured to be at different heights from the bus bar.

In such pyrotechnic circuit breakers, a recurring issue resides in the reliability of the cut of the bus bar, while ensuring a proper electrical conduction when the circuit is in operation.

The bus bar indeed needs having a thickness sufficient for providing appropriate electric conduction properties. However increasing the thickness of the bus bar makes its cutting more difficult, and therefore requires an oversizing of the piston for ensuring a reliable cut, which results in an oversizing of the whole device.

SUMMARY OF THE INVENTION

The present invention aims at providing an improved device for responding to these technical issues.

With this respect, the present invention relates to a pyrotechnic circuit breaker, comprising a body, an igniter, a piston and a bus bar, wherein the igniter, the piston and the bus bar are adapted to be accommodated within the body, and wherein the piston comprises a cutting edge and is adapted move along a normal direction to cut a portion of the bus bar, thereby separating the bus bar into a proximal portion and a distal portion in order to break a circuit, wherein the cutting edge of the piston is stepped so that the portion of the bus bar is cut sequentially, in at least two successive cutting operations along the movement of the piston from a raised position to a lowered position, characterized in that the bus bar typically comprises a breakable portion configured to be cut by the cutting edge of the piston, wherein said breakable portion comprises slots in order to divide the breakable portion into multiple sub-portions that are adapted to be cut sequentially by the stepped cutting edge of the piston.

Said slots can be arranged along a longitudinal direction of the bus bar.

The bus bar typically comprises at least one groove arranged along a transversal direction of the bus bar, said at least one groove forming a starting line of a fracture of the bus bar when the cutting edge of the piston moves from its a raised position to its lowered position.

The bus bar can then present two grooves arranged on two opposite sides of the bus bar, said grooves being offset with respect to the longitudinal direction. Both grooves can be of identical shape, and each define a portion of reduced thickness of the bus bar where the thickness equals Thmin, and wherein the minimum thickness of the bus bar between said two grooves equals Thmin.

The bus bar typically comprises means for engaging the bus bar with the body of the pyrotechnic circuit breaker, said means being adapted to lock the bus bar in position with respect to the body of the pyrotechnic circuit breaker. Said means for engaging the bus bar with the body of the pyrotechnic circuit breaker can comprise blades and/or notches arranged in the bus bar, adapted to come in contact with the body of the pyrotechnic circuit breaker.

PRESENTATION OF THE DRAWINGS

Other features, aims and advantages of the invention will be detailed in the following description, which is purely illustrative and should not be interpreted in a limiting way, and which should be read in view of the enclosed drawings, wherein:

FIG. 1 discloses a pyrotechnic circuit breaker according to an aspect of the invention;

FIG. 2 discloses an exploded view of this pyrotechnic circuit breaker

Figure 5:
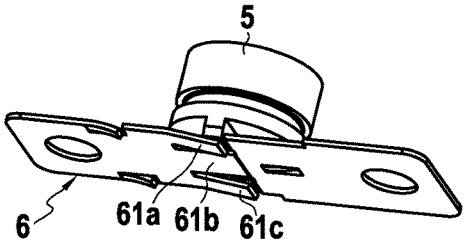
Figure 6:
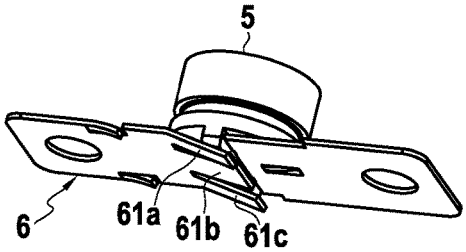
Figure 7:
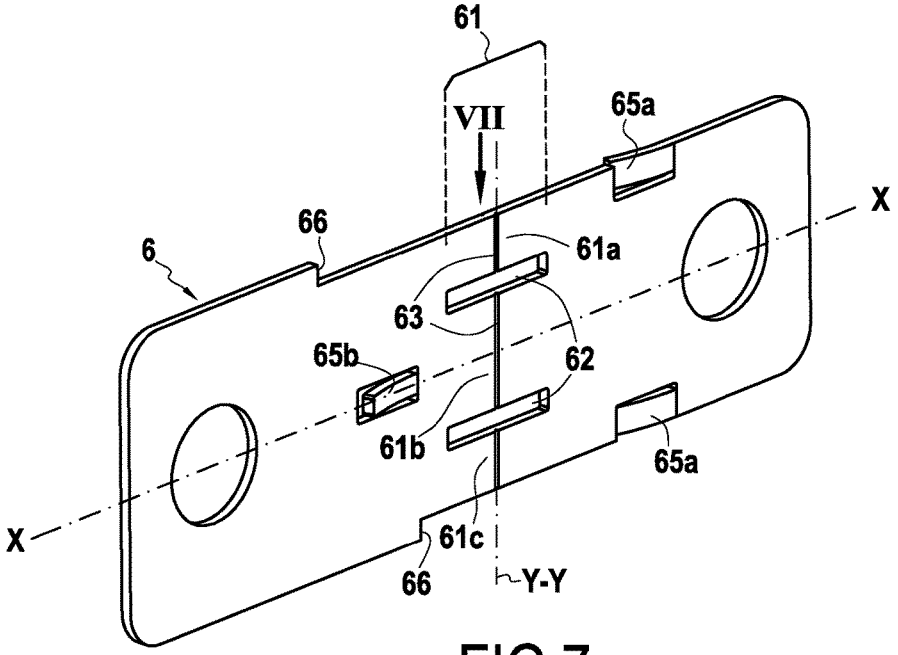
Figure 8:
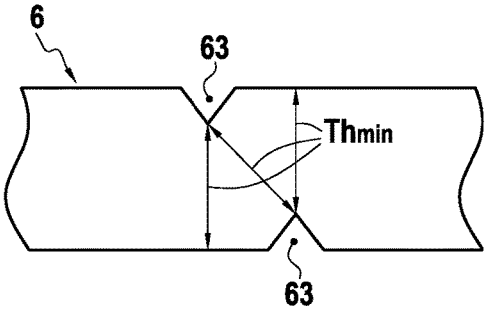
Figure 9:
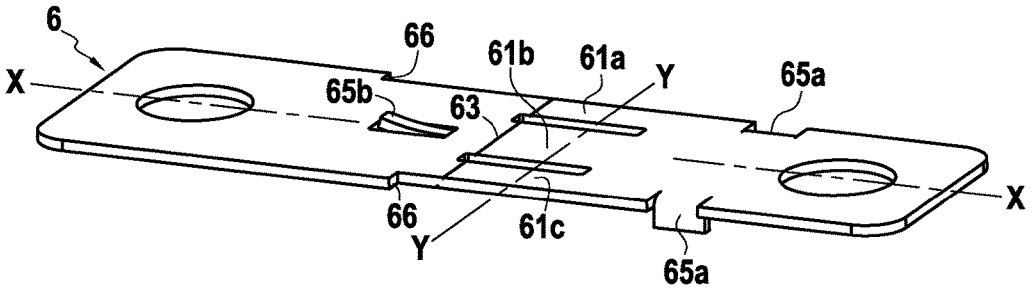
Figure 10:
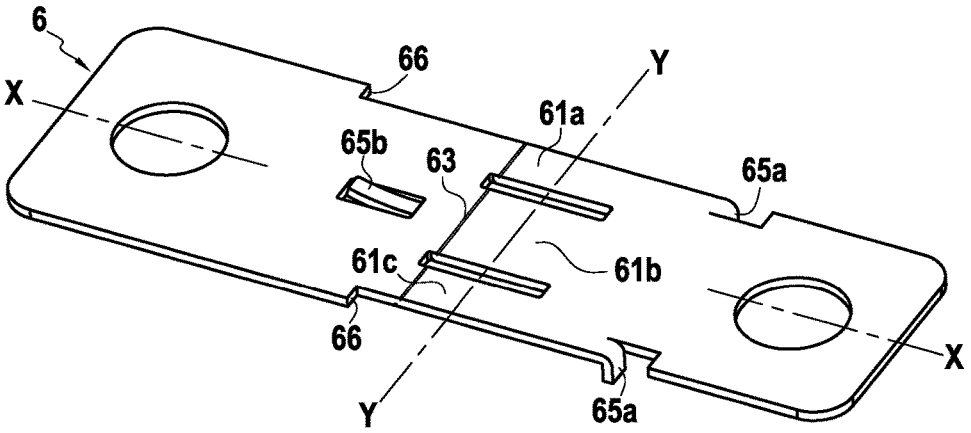
Figure 11:
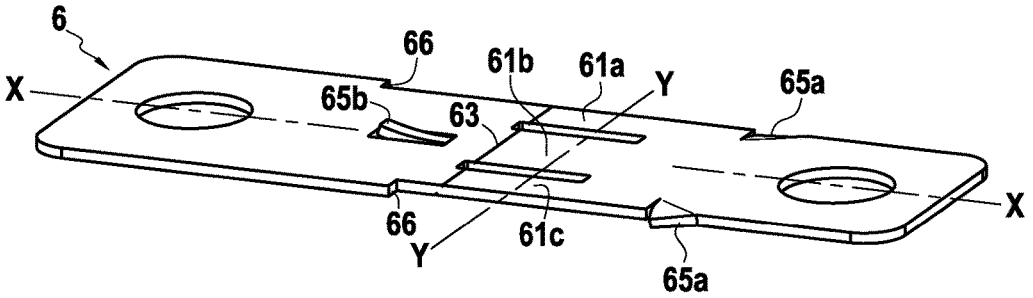

FIGS. 5 and 6 disclose the different steps of the cut of a bus bar with three separated areas to cut, using an example of the multi-stage blade of the piston showing two different levels;

FIGS. 7 and 8 are views of an example of a bus bar of the pyrotechnic circuit breaker with three separated area to cut;

FIGS. 9 to 11 are views of other examples of bus bars of the pyrotechnic circuit breaker.

In all these figures, the common elements are identified by identical numeral references.

DETAILED DESCRIPTION

The pyrotechnic circuit breaker 1 disclosed in the figures comprises a body 2,
a retainer 3
an igniter 4,
a piston 5,
a bus bar 6, and
an anvil 7.

The body 2, the anvil 7 and the piston 5 are typically made of non-conductive material, while the bus bar 6 is made of electrically conductive material.

The body 2 and the anvil 7 are assembled, for instance using screws or bolts, in order to define an inner cavity that is configured to accommodate the igniter 4, the piston 5 and the bus bar 6. The retainer 3 is typically positioned within a recess made in an outer surface of the body 2.

The retainer 3 is mounted in a top portion of the body 2. The igniter 4 is configured to trigger the displacement of the piston 5 which is slidably engaged within an inner space of the body 2, so that the piston moves towards the anvil 7. The piston 5 can move along a normal direction of the pyrotechnic circuit breaker 1, represented by the axis Z-Z on the drawings, between a raised position and a lowered position.

The bus bar 6 goes through a slot formed within the body 2, and is perpendicular to the normal direction Z-Z of the pyrotechnic circuit breaker 1. A portion of the bus bar 6 is therefore located within the inner cavity defined by the body 2 and the anvil 7, and is positioned between the anvil 7 and the piston 5, while two longitudinal ends of the bus bar 6 extend outside of the body 2.

As long as the igniter 4 has not been used, the piston 5 remains in its raised position. Upon its actuation, the igniter 4 is configured to drive the piston 5 from its raised position to its lowered position.

During this movement, the piston 5 comes into contact with the bus bar 6, which is positioned within the body 2, so that the normal direction of the pyrotechnic circuit breaker 1 is perpendicular to the surface of the bus bar 6.

The piston 5 comprises a cutting edge 51, protruding from a lower face, and adapted to come into contact with the bus bar 6, in order to cut or break a portion of the bus bar 6 to separate it into two distinct portions, that will arbitrarily be designated as a proximal portion and a distal portion, in order to break the electrical condition of the bus bar 6.

The anvil 7 is arranged within the body 2 so that the blade 6 is positioned between the anvil 7 and the piston 5, and is typically configured to define the lowered position of the piston 5, so that the anvil 7 defines the maximum displacement of the piston 5 along the normal direction Z-Z, said maximum displacement corresponding to the lowered position of the piston 5.

The anvil 7 comprises a receiving groove 71, configured to allow the displacement of the cutting edge 51 of the piston 5 through the bus bar 6.

In the present pyrotechnic circuit breaker 1, the cutting edge 51 of the piston 5 is stepped so that the bus bar 6 is cut sequentially, in at least two successive cutting operations along the movement of the piston 5 from the raised position to the lowered position.

More specifically, the cutting edge 51 of the piston 5 is not linear, but is stepped, and comprises portions defining at least two different levels in terms of height with respect to the normal direction Z-Z, that come into contact sequentially with the bus bar upon the movement of the piston 5 along the normal direction Z-Z from the raised position to the lowered position.

Figure 1:
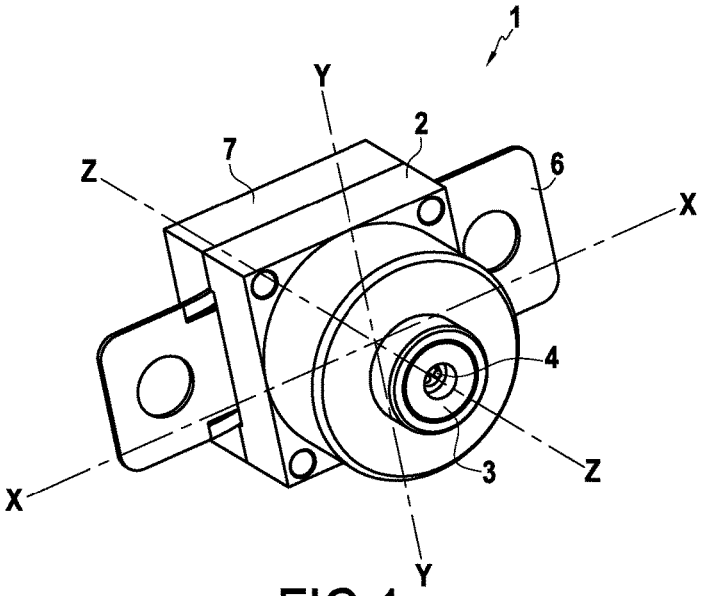
Figure 2:
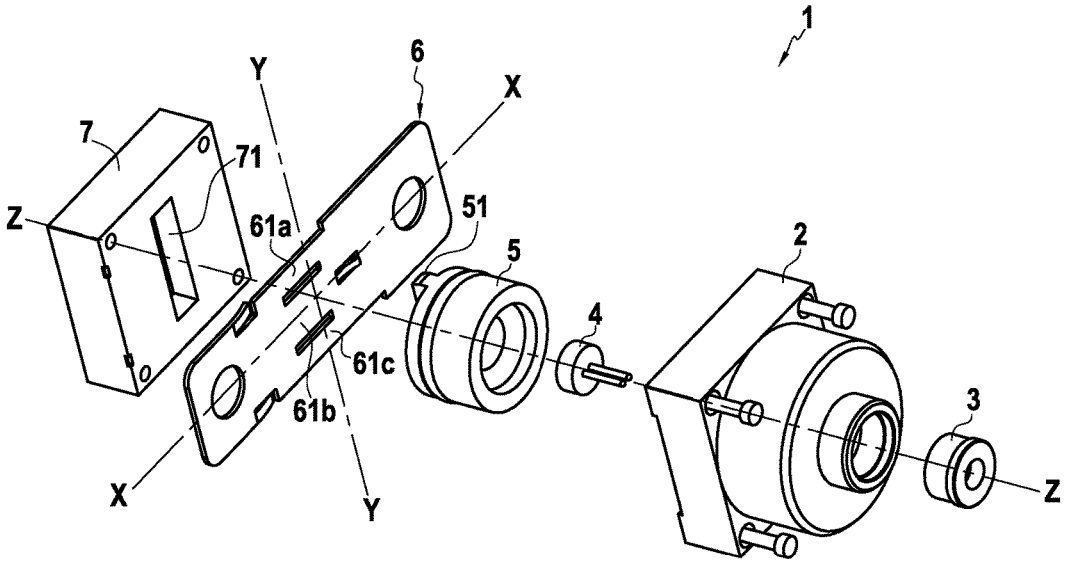
Figure 3:
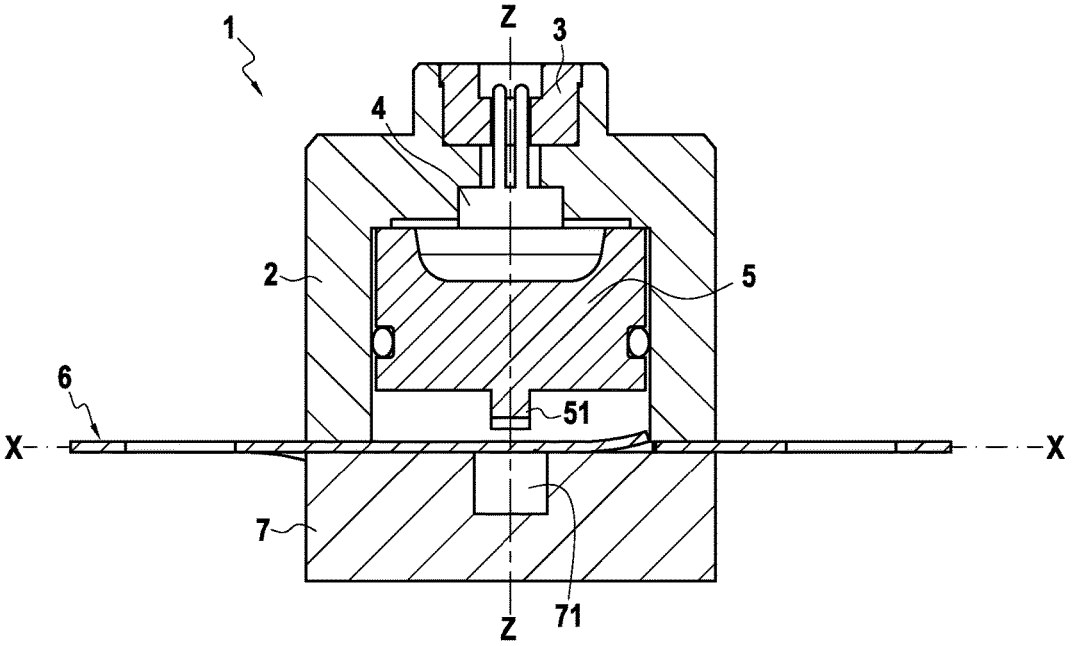
FIG. 3 is a cross section view of the pyrotechnic circuit breaker, along the plane defined by the axis Z-Z and X-X of FIG. 1.
Figure 4:
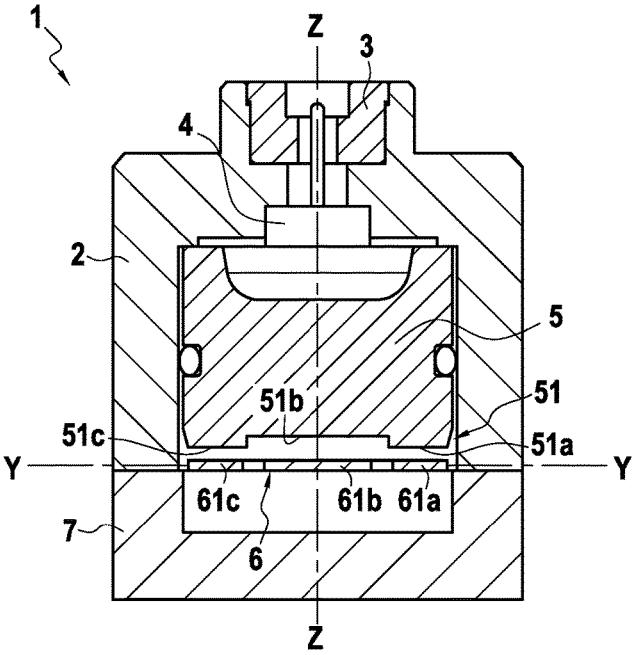
FIG. 4 is a cross section view of the pyrotechnic circuit breaker, along the plane defined by the axis Z-Z and Y-Y of FIG. 1.

As shown in FIG. 4, in the illustrated embodiment, the cutting edge 51 of the piston 5 is stepped; it comprises two lateral portions 51*a* and 51*c*, and a central portion 51*b* that are configured so that the two lateral portions 51*a* and 51*c* protrude over the central portion 51*b*.

With such a configuration, the two lateral portions 51*a* and 51*c* come into contact with the bus bar 6 before the central portion 51*b*, and therefore cut or break lateral portions of the bus bar 6 before the central portion 51*b* of the cutting edge 51 cuts or breaks a central portion of the bus bar 6, thereby separating it into two distinct portions.

The cutting or breaking operation of the bus bar 6 is therefore segmented into multiple sub operations, instead of a single cutting operation.

FIGS. 5 and 6 represent these successive cutting sub operations of the blade 6 by the stepped piston 5, with the lateral portions 51*a* and 51*c* that are cut in a first sub operation illustrated in FIG. 5, and the central portion 51*b* which is cut in a second sub operation illustrated in FIG. 6.

Such a segmentation of the cutting of breaking operation of the bus bar 6 into multiple sub operations enables to reduce the stress on the whole device during the cutting of breaking of the bus bar 6, when compared to a single cutting or breaking operation of a similar bus bar 6.

This enables to both improve the reliability of the device, and to avoid an excessive oversizing of the device to ensure such reliability.

Additionally, cutting the lateral portions of the bus bar 6 in a first time, and then cutting the central portion of the bus bar 6 in a second time enables to reduce the risks of formation of electric arcs.

Various configurations of a stepped cutting edge 51 of the piston 5 are possible.

The cutting edge 51 can be segmented into multiple portions of various levels, in order to initiate the cutting or breaking of the bus bar on its lateral portions or on its central portion.

Each portions of various level of the cutting edge 51 are in a preferred design of the invention parallel of the groove of the bus bar but can also present various angles allowing to tune the breaking efforts on such portions in progressive or decreasing way.

The cutting or breaking operation of the bus bar can be segmented into 2, 3 or more sub operations; the number of sub operations typically depending on the shape and size of the bus bar 6 and on the requirements for the device.

The bus bar 6 typically comprises a breakable portion 61 adapted to be cut or broken by the piston 5, which comprises slots in order to divide said breakable portion 61 into multiple sub-portions that are adapted to be cut sequentially by the stepped cutting edge 51 of the piston 5.

More specifically, as illustrated in FIG. 7, the bus bar comprises two slots 62 arranged along a longitudinal direction X-X of the bus bar 6, which therefore divides the breakable portion 61 into three sub portions 61*a*, 61*b* and 61*c*, adapted to be cut or broken respectively by the portions 51*a*, 51*b* and 51*c* of the cutting edge 51 of the piston 5.

The number and shape of the slots 62 can be adapted to the shape of the cutting edge 51 of the piston 5.

Having the slots 62 arranged along a longitudinal direction X-X of the bus bar 6 enables to minimize the impact of the slots 62 on the electrical conductivity of the bus bar 6.

The bus bar 6 can also comprise one or more grooves 63 arranged on said breakable portion 61, in order to form starting lines of fracture of the bus bar 6, which improves the reliability of the breaking of the circuit when the cutting edge of the piston cuts or breaks the bus bar 6.

Such grooves 63 are for instance illustrated in FIG. 8, and typically present a triangular shape.

These grooves 63 can be made whatever the number and the shape of the slots 62 (eg 0 at the minimum).

In the embodiment illustrated in FIG. 8, the bus bar 6 comprises two grooves 63, arranged in the two opposite sides of the bus bar 6.

Each groove 63 defines a portion of reduced thickness of the bus bar 6, where the fracture of the bus bar 6 due to the action of the piston 5 will therefore occur since the mechanical resistance of the bus bar 6 in these portions of reduced thickness is reduced.

According to a specific embodiment illustrated in FIG. 8, both the grooves 63 have the same shape and depth, so that each of the portions of reduced thickness of the bus bar 6 have a same thickness Epmin.

Additionally, the grooves 63 are typically arranged so that the minimum thickness of the bus bar 6 between the grooves 63 equals Epmin.

Such a configuration therefore ensures a minimum thickness of the bus bar 6, even in its portions that are configured to form starting lines of fracture of the bus bar 6.

The bus bar 6 can also comprise engaging and locking means configured for engaging the bus bar 6 with the body 2 of the pyrotechnic circuit breaker 1.

In the embodiment disclosed in the drawings, and more specifically in FIG. 5, the engaging means comprise blades 65 and notches 66 are adapted to abut against opposing sides of the body 2. The blades 65 comprise two lateral blades 65*a* arranged on the lateral edges of the bus bar 6, and a central blade 65*b* arranged along the central longitudinal axis X-X of the bus bar 6.

In the embodiment illustrated in FIG. 7, the blades 65 are bent along transversal fold lines, parallel to axis Y-Y and away from the notches 66, in order to protrude from the upper and lower sides of the bus bar 6 facing the notches 66, so that they abut with surfaces of the anvil 7 or of the body 2. The notches 66 are also adapted to abut with surfaces of the anvil 7 or of the body 2, opposite to the surfaces against which the blades 65 abut. The combination of the blades 65 and the notches 66 therefore immobilizes the bus bar 6 with respect to the body 2.

In the illustrated embodiment, the bus bar 6 comprises two notches 66 that are arranged in an asymmetrical configuration. Such an asymmetrical configuration enables the notches 66 to act as guiding means for ensuring that the bus bar 6 is properly inserted in the body 2.

The blades 65 and notches 66 provide a precise positioning of the bus bar 6 with respect to the body 2, and therefore enable a precise positioning of the slots 62 and grooves 63 of the bus bar 6 with respect to the cutting edge 51 of the piston 5 to ensure that the cutting of the bus bar 6 occurs in a predetermined location of the bus bar 6.

FIGS. 9 to 11 disclose alternative embodiments of the bus bar 6 disclosed in FIG. 7.

In the alternative embodiment disclosed in FIG. 9, the lateral blades 65*a* are bent along longitudinal fold lines, parallel to the longitudinal axis X-X.

In the alternative embodiment disclosed in FIG. 10, the lateral blades 65*a* are bent along transversal fold lines, parallel to axis Y-Y and close to the notches 66, so that the lateral blades 65 protrude from the upper and lower sides of the bus bar 6 with their free ends away from the notches 66.

In the alternative embodiment disclosed in FIG. 11, the lateral blades 65*a* are bent along oblique fold lines, to form triangular protuberances that protrude from the upper and lower sides of the bus bar 6.

The pyrotechnic circuit breaker therefore enables to achieve a reliable breaking of a circuit, with a reduced stress on the piston and therefore an improved reliability of the device without requiring an oversizing of its components.

The invention claimed is:

1. A pyrotechnic circuit breaker, comprising a body, an igniter, a piston, and a bus bar which extends along a longitudinal direction, wherein the igniter, the piston, and the bus bar are accommodated within the body, and wherein the piston comprises a cutting edge and is slidably arranged within the body to move along a normal direction that is perpendicular to the longitudinal direction to cut a portion of the bus bar, thereby separating the bus bar into a proximal portion and a distal portion in order to break a circuit, wherein the cutting edge of the piston is stepped so that the portion of the bus bar is cut sequentially along a same cutting line in a transverse direction of the bus bar, in at least two successive cutting operations along the movement of the piston from a first position to a second position, the transverse direction being perpendicular to the longitudinal direction and the normal direction, wherein the bus bar comprises a breakable portion, which comprises slots in order to divide the breakable portion into multiple sub-portions, and wherein the movement of the piston from the first position to the second position cuts the breakable portion sequentially, and wherein the cutting edge of the piston extends along a lateral axis of the piston that is perpendicular to a longitudinal axis of the piston, and the cutting edge includes a first lateral portion, a second lateral portion, and a central portion extending along the lateral axis, the central portion being disposed between the first lateral portion and the second lateral portion along the lateral axis, and the central portion is recessed relative to the first lateral portion and the second lateral portion.

2. The pyrotechnic circuit breaker of claim 1, wherein said slots are arranged along the longitudinal direction of the bus bar.

3. The pyrotechnic circuit breaker of claim 1, wherein the bus bar comprises at least one groove arranged along the transverse direction of the bus bar, said at least one groove forming a starting line of a fracture of the bus bar when the cutting edge of the piston moves from its first position to its second position.

4. The pyrotechnic circuit breaker of claim 3, wherein the bus bar comprises two grooves arranged on two opposite sides of the bus bar, said grooves being offset with respect to the longitudinal direction.

5. The pyrotechnic circuit breaker of claim 4, wherein both grooves are of identical shape, and each define a portion of reduced thickness of the bus bar where the thickness equals Thmin, and wherein the minimum thickness of the bus bar between said two grooves equals Thmin.

6. The pyrotechnic circuit breaker of claim 1, wherein the bus bar comprises blades and/or notches arranged in the bus bar for engaging the bus bar with the body of the pyrotechnic circuit breaker, said blades and/or notches arranged in the bus bar locking the bus bar in position with respect to the body of the pyrotechnic circuit breaker.

7. The pyrotechnic circuit breaker of claim 1, wherein the first lateral portion and the second lateral portion come into contact with the bus bar before the central portion.

8. The pyrotechnic circuit breaker of claim 7, wherein the first lateral portion and the second lateral portion cut lateral portions of the bus bar before the central portion cuts a central portion of the bus bar.

* * * * *